United States Patent [19]

Hladun

[11] Patent Number: 4,743,341

[45] Date of Patent: May 10, 1988

[54] APPARATUS FOR THE PYROLYSIS OF HYDROCARBON CONTAINING MATERIALS

[75] Inventor: Kenneth W. Hladun, Narberth, Pa.

[73] Assignees: Harry S. Allen; John L. Buzzi, both of Piscataway, N.J.

[21] Appl. No.: 517,659

[22] Filed: Jul. 27, 1983

[51] Int. Cl.[4] ..... C10B 1/06; C10B 47/26

[52] U.S. Cl. ..... 202/99; 48/92; 201/10; 201/11; 202/208; 202/219

[58] Field of Search ..... 201/11, 10; 202/219, 202/99, 208; 196/118; 48/92; 431/284, 278; 266/269, 265

[56] References Cited

U.S. PATENT DOCUMENTS

| | | | |
|---|---|---|---|
| 272,959 | 2/1883 | Hoyt | 202/99 |
| 1,172,682 | 2/1916 | Doherty | 48/92 |
| 1,242,339 | 10/1917 | Fulton et al. | 202/99 |
| 1,709,370 | 4/1929 | Piron et al. | 202/219 |
| 2,730,488 | 1/1956 | Rosset et al. | 202/219 |
| 3,729,297 | 4/1973 | Yoshida et al. | 48/92 |

FOREIGN PATENT DOCUMENTS

| | | | |
|---|---|---|---|
| 408593 | 10/1922 | Fed. Rep. of Germany | 202/4 |
| 26705 | 2/1916 | Norway | 202/219 |
| 207460 | 11/1923 | United Kingdom | 202/219 |

*Primary Examiner*—Jay H. Woo
*Assistant Examiner*—Joye L. Woodard
*Attorney, Agent, or Firm*—Norman E. Lehrer

[57] ABSTRACT

A pyrolysis chamber includes a bath of molten salt divided by a horizontally disposed baffle into an upper layer and a lower layer. Connected to one end of the chamber is a furnace including submerged burners for heating the salt and for maintaining it in its molten state. The molten salt flows from the furnace across the upper bath layer and back to the furnace in the lower layer. Hydrocarbon containing material is fed onto the upper bath layer and is pyrolyzed as it moves toward the discharge end of the chamber where the spent material is removed; the hydrocarbon gases being recovered by an exhaust system in the chamber. The molten salt acts as a seal between the atmospheres of the furnace and the pyrolysis chamber and also functions to remove pollutants from the combustion gases of the burners in the furnace.

9 Claims, 2 Drawing Sheets

APPARATUS FOR THE PYROLYSIS OF HYDROCARBON CONTAINING MATERIALS

BACKGROUND OF THE INVENTION

The present invention is directed toward the pyrolysis of hydrocarbon containing materials and more particularly toward a system which provides for near perfect pyrolysis of an extremely wide range of materials and which requires no air pollution control equipment.

There are a great number of industrial by-products, consumer discards, bio-mass substances, low-grade coal and oil shale which could be used as energy and commodity sources provided that suitable means could be produced to convert these various materials to conventional fuels such as natural gas, fuel oil or any other combustible liquid or gaseous fuel or other commodity which is normally used by industry or the general public. These same substances can also be used as feedstock for the manufacture of chemicals, solvents, activated carbon and a number of other commerical products.

The key to converting these hydrocarbons is a device or system which can continuously and controllably pyrolyze these substances to produce an intermediate gas which can be collected, condensed, liquified, compressed, separated or otherwise processed with efficiency to yield the desired products. While attempts have been made to accomplish these results, the existing state of the art in pyrolytic technology does not allow for these possibilities in a controlled, efficient, simple and ecologically acceptable manner.

SUMMARY OF THE INVENTION

The present invention is designed to achieve the desired results described above and allows for near perfect pyrolysis of an extremely wide range of materials. The present process is self-sustaining in that it derives its energy from the feedstock and it requires no air pollution control equipment because of its ability to sequester all of the potential pollutants within the process. The present invention can handle toxic and hazardous wastes as well and can be operated to either convert them to usable substances or to completely destroy them.

According to the invention, a pyrolysis chamber includes a bath of molten salt divided by a horizontally disposed baffle into an upper layer and a lower layer. Connected to one end of the chamber is a furnace including submerged burners for heating the salt and for maintaining it in its molten state. The molten salt flows from the furnace across the upper bath layer and back to the furnace in the lower layer. Hydrocarbon containing material is fed onto the upper bath layer and is pyrolyzed as it moves toward the discharge end of the chamber where the spent material is removed; the hydrocarbon gases being recovered by an exhaust system in the chamber. The molten salt acts as a seal between the atmospheres of the furnace and the pyrolysis chamber and also functions to remove pollutants from the combination gases of the burners in the furnace. As a result of the invention, control of the thermal input to the feedstock is superior to any known device and the degree to which the pyrolysis chamber is sealed and isolated is unprecedented and allows for superior control over product quality.

BRIEF DESCRIPTION OF THE DRAWINGS

For the purpose of illustrating the invention, there is shown in the accompanying drawings one form which is presently preferred; it being understood that the invention is not intended to be limited to the precise arrangements and instrumentalities shown.

DETAILED DESCRIPTION OF THE PREFERRED EMBODIMENT

Figure 1:
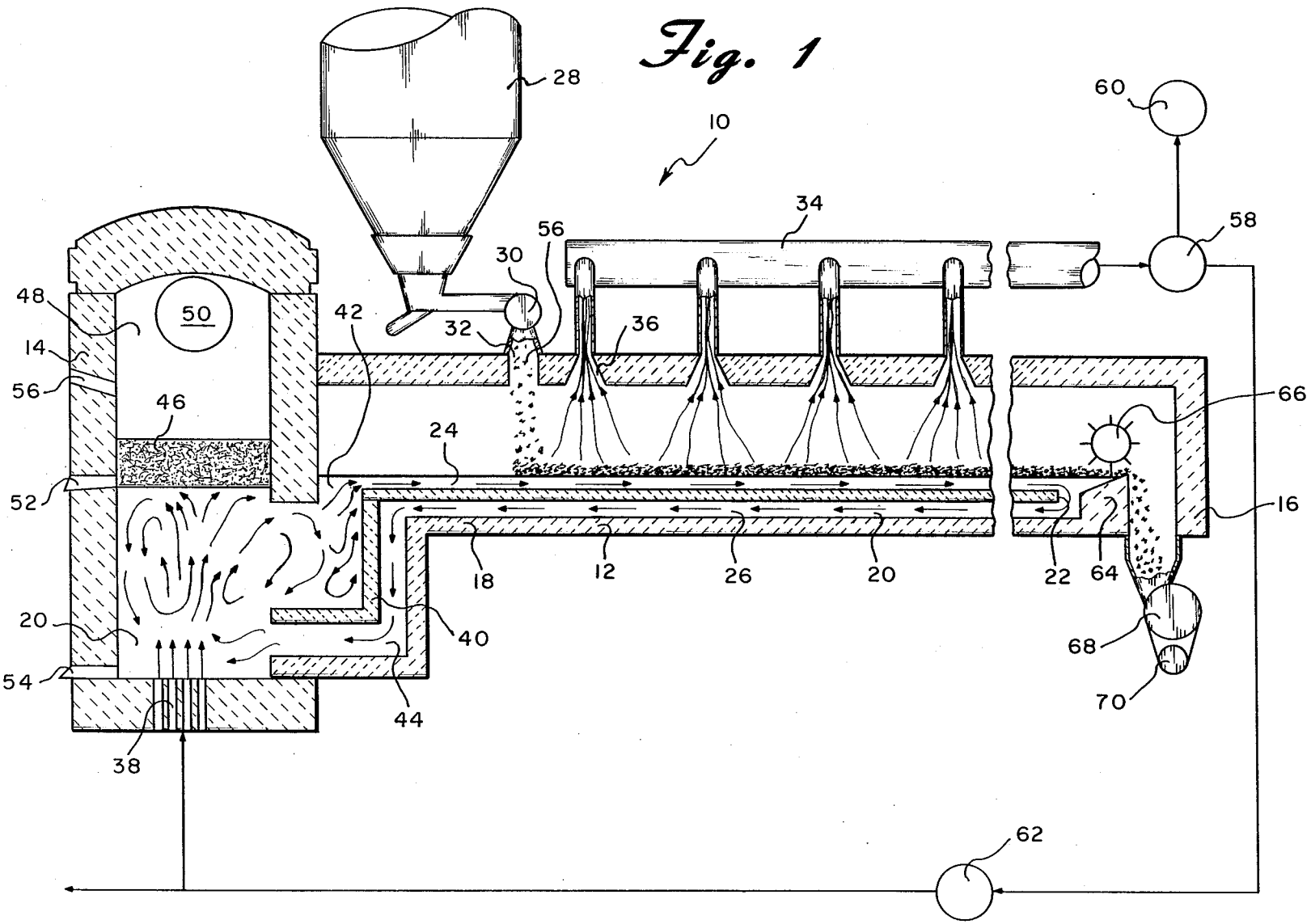
FIG. 1 is a schematic representation, shown primarily in section, of a system constructed in accordance with the principles of the present invention.

Referring now to the drawings in detail wherein like reference numerals have been used in the two figures for designating like elements, there is shown in FIG. 1 a system for the pyrolysis of hydrocarbon containing materials constructed in accordance with the principles of the present invention and designated generally as 10. The system 10 is comprised essentially of two parts: a pyrolysis chamber 12 and a furnace 14.

The pyrolysis chamber 12 has one end connected to the furnace 14 and extends outwardly in a horizontal direction and terminates at its discharge end 16. The top and side walls of the pyrolysis chamber 16 are preferably made of insulated stainless steel or other refractory material. The bottom wall 18, however, which is subjected to substantially higher temperatures is preferably comprised of alumino-silicate refractory material.

Located within the pyrolysis chamber 12 is a bath of molten metal, molten salt or the combination thereof as shown at 20. A horizontally disposed refractory baffle 22 separates the molten bath into an upper layer 24 and a bottom layer 26. For the reasons which will become more apparent hereinafter, the molten bath in the upper layer 24 tends to move from the furnace end of the pyrolysis chamber toward the discharge end while the molten bath in the lower layer 26 functions as a return and moves from the discharge end of the chamber back toward the furnace 14.

Located above the pyrolysis chamber 12 is a storage hopper 28 and a feed mechanism including a rotating vane seal mechanism 30 which feeds material into the pyrolysis chamber through opening 32 is the upper wall thereof. Also located above the pyrolysis chamber is a header 34 which is connected to a plurality of off-takes 36 in the upper wall of the chamber.

The furnace 14 is connected to the first end of the pyrolysis chamber 12 and includes a plurality of submerged burners 38 which will be described in more detail hereinafter. The molten metal or salt 20 which forms the bath of the pyrolysis chamber also fills the lower portion of the furnace 14 which is open at its right side thereof (as viewed in FIG. 1) so as to allow communication between the molten bath in the furnace and in the pyrolysis chamber.

A baffle 40 continues the separation of the bath into two layers as produced by the baffle 22 and forms an upper riser throat 42 and a down coming throat 44. It can be seen that the molten salt or metal 20 in the riser throat 42 forms an effective seal between the atmosphere in the furnace 14 and the pyrolysis chamber 12.

Located above the molten material 20 in the furnace 14 is a layer of reactive molten salt 46. The gases generated by the burners 38 pass through the layer of salt 46 where pollutants are extracted either by chemical reaction, entrainment or absorption. The clean gases then pass through the upper furnace chamber 48 to an exhaust duct 50. Spent molten salts can be extracted at the tap location 52, spent molten material can be extracted at tap location 54 and both materials can be replenished through aperture 56. It should be noted that if salt is used as the molten bath material 20, then it may not be necessary to add an additional molten salt layer 46 for pollution control.

The system described above functions in substantially the following manner. The submerged burners 38 create an upward current which, in combination with the tendency for heated fluids to rise and cooler ones to settle, causes motion of the molten bath 22 in the direction shown by the arrows in the pyrolysis chamber 12. That is, the bath in the upper layer 24 tends to move from the furnace toward the discharge end 16 while the bath in the lower layer 26 tends to move from the discharge end 16 back toward the furnace 14.

Hydrocarbon containing feedstock or material 56 is fed from the storage hopper 28 onto the upper layer 24 of the molten bath 20 by way of the rotating vane seal mechanism 30 and the opening 32. The feedstock 56 which has previously been converted to appropriate particle size has a lower density than the molten material 20 so that it floats on the same.

The feedstock is caused to advance toward the discharge end 16 by the movement of the bath 20. During this time, heat is transferred from the molten material 20 to the feedstock causing the volatilization of hydrocarbons which, in the gaseous state, are withdrawn by induced draft through the off-takes 36 and through the header 34 to the hydrocarbon recovery device 58. In a known manner, recovered hydrocarbons are stored in vessels 60 and the nonrecovered gaseous portion is passed on to a gas conditioning and compressing system 62. From there, gas is proportioned to the submerged burners 38 or is otherwise sold to a customer, stored or disposed of.

The spent feedstock 56 at the discharge end of the pyrolysis chamber is forced over the refractory ledge 64 by the use of a paddle wheel 66. The spent feedstock falls by gravity to a rotary vane mechanism 68 from where it is fed to a conveyer 70. The feedstock is then subjected to further processing or is discarded.

The molten bath 20 then continues to flow in the lower layer 26 back toward the furnace 14. The heat lost by the molten bath 20 in the pyrolysis chamber 12 is replenished by the submerged burners 38 in the furnace.

Figure 2:
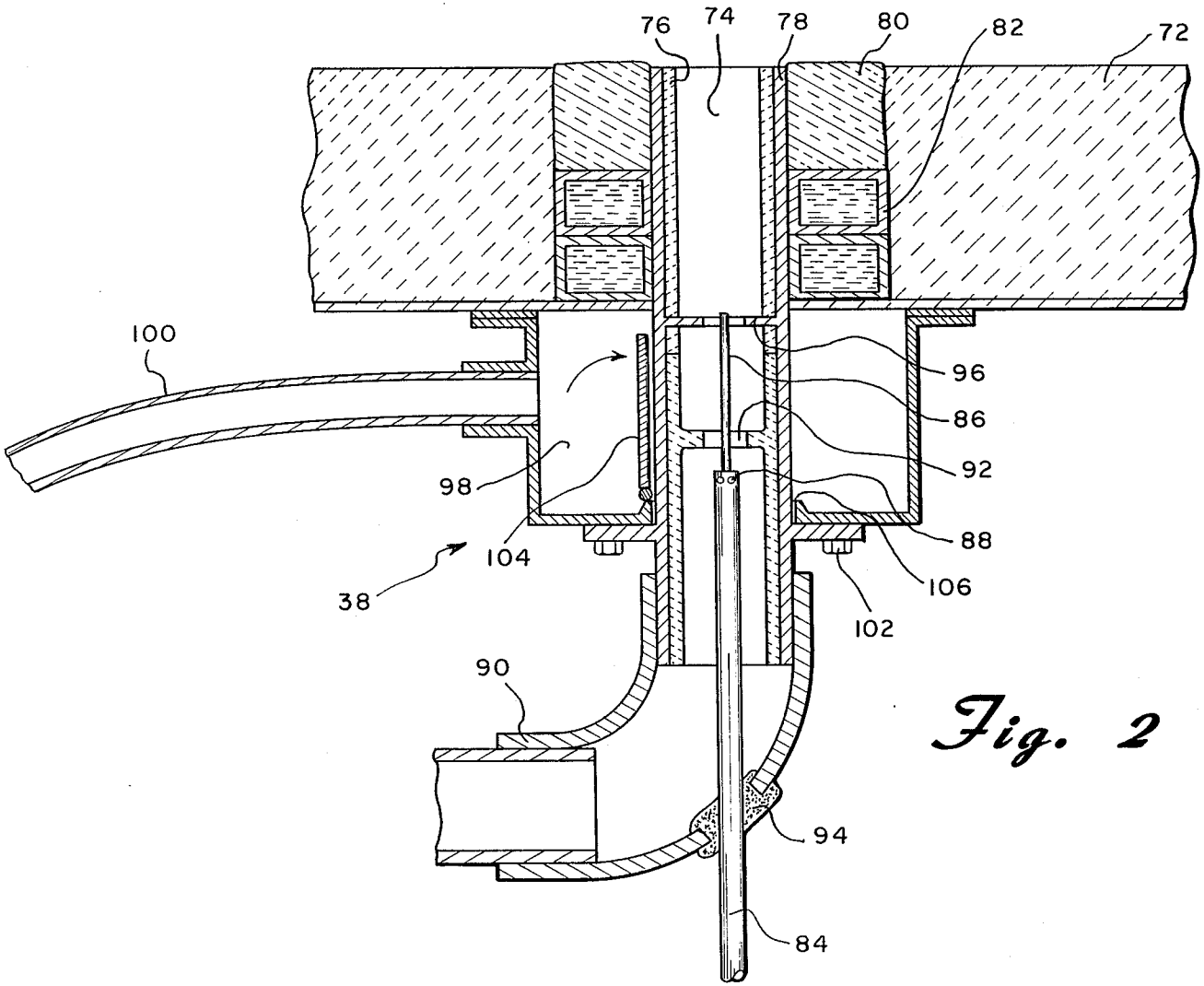
FIG. 2 is a sectional view of a submerged burner unit forming part of the invention.

FIG. 2 illustrates a novel submerged burner which may be used in the furnace 14 described above. In the preferred form of the furnace, a plurality of such burners will be utilized; the number depending on the size and specific geometry of the furnace. Each burner is preferably constructed as shown in FIG. 2.

The burner 38 is mounted in the lower wall 72 of the furnace 14. The combustion chamber 74 includes refractory silicon carbide walls 76 which are surrounded by a stainless steel tube 78 which, at its upper end, is encircled by silicon carbide refractory insulation 80. Located beneath the insulation 80 and also surrounding the stainless steel tube 78 are water-cooled jackets 82.

Combustible gases are supplied to the combustion chamber through tube 84. The top end of tube 84 is closed by an extension electrode 86. The fuel gases are delivered by the tube 84 through orifices 88. Air or oxygen under pressure is delivered to the burner through conduit 90. The air and fuel gases move upwardly through the burner and are mixed by mixing orifice 92 as they move upwardly into the combustion section 74 where combustion takes place. It should be readily apparent that because of the high pressure air, the combustion and hot combustion gases also move upwardly into the furnace itself.

The burner 38 is equipped with an electric igniter. The electrode 86 at the top of the tube 84 functions as one of the electrode igniters and power to that electrode is provided through the tube 84. For this reason, tube 84 is insulated from conduit 90 by insulator 94. With electric power supplied to the electrode 86 through tube 84, a spark can be generated against the extension 96 of the stainless steel tube 78.

Occasionally it becomes necessary to repair or replace a burner unit. The present invention provides a means for removing a single unit for repair without having to shut down or cool down the furnace.

To accomplish this, fuel to the burner to be removed is turned off while the remaining burners continue to be on so that the molten bath 20 in the furnace remains molten. The compressed air through conduit 90 is not, however, shut off so that air continues to be forced upwardly into the furnace. This prevents the molten bath 20 from flowing down into the burner.

Compressed air is then also provided to the plenum 98 which surrounds the lower portion of the burner and which also surrounds the opening in the furnace bottom wall 72. This compressed air is provided through conduit 100. Bolts 102 which retain the outer stainless steel tube of the burner to the plenum are then removed and the burners slowly moved downwardly and withdrawn from the bottom wall 72 of the furnace.

As the burner moves downwardly, compressed air is continued to be delivered through conduit 90. As the uppermost end of the stainless steel tube 78 reaches the lowermost portion of the bottom wall 72, compressed air in the plenum 98 begins to move upwardly into the furnace 14 to prevent molten material from flowing downwardly through the opening. The burner continues to be moved downwardly until it is totally withdrawn from the plenum 98. At this time, the flapper valve 104 closes off the opening 106 through which the burner had been inserted through the plenum and provides an airtight seal. At all times, compressed air continues to be delivered to the plenum 98 through the conduit 100 and then upwardly into the furnace to prevent the molten bath 20 from flowing out of the furnace. After the burner has been repaired or replaced, it is reinserted in precisely the same manner.

The present invention may be embodied in other specific forms without departing from the spirit or essential attributes thereof and accordingly reference should be made to the appended claims rather than to the foregoing specification as indicating the scope of the invention.

I claim:

1. Apparatus for the pyrolsis of hydrocarbon containing materials comprising:

a horizontally extending pyrolysis chamber including a moving bath of molten material at the bottom thereof;

means adjacent a first end of said chamber for feeding raw hydrocarbon containing material onto said bath;

means adjacent the second end of said chamber for removing spent material from said bath after it has traveled on the bath for substantially the length of said chamber;

exhaust means for recovering hydrocarbon containing gases from said chamber;

a furnace adjacent the first end of said chamber for heating said molten material to form said bath;

said furnace including a plurality of openings in a wall thereof adjacent the lower portion of said furnace and including a plurality of removable burners passing through said openings so as to be submerged within said molten material;

means associated with said burners for directing compressed air into said furnace through one of said openings when one of said burners is removed so as to prevent said molten material from flowing out of said furace through said opening;

a layer of molten salt supported on top of the molten material within said furnace for removing pollutants from the combustion gases passing up through said molten material from said burners, and tap means in a wall of said furnace for removing spent salt therefrom.

2. The apparatus as claimed in claim 1 wherein said molten material is salt.

3. The apparatus as claimed in claim 1 wherein said molten material is metal.

4. The apparatus as claimed in claim 1 further including a horizontally disposed baffle located within the bath of molten material within said chamber and dividing the same into an upper layer and a lower layer, the molten material in said upper layer moving from said furnace toward the second end of said chamber and the molten material in said lower layer moving from said second end back to said furnace.

5. The apparatus as claimed in claim 4 wherein said furnace and said chamber are arranged and constructed such that said molten material forms a seal between the atmosphere within said furnace and said chamber.

6. Apparatus for the pyrolysis of hydrocarbon containing materials comprising:

a horizontally extending pyrolysis chamber including a moving bath of molten material at the bottom thereof;

means adjacent a first end of said chamber for feeding raw hydrocarbon containing material onto said bath;

means adjacent the second end of said chamber for removing spent material from said bath after it has traveled on the bath for substantially the length of said chamber;

exhaust means for recovering hydrocarbon containing gases from said chamber;

a furnace adjacent the first end of said chamber for heating said molten material to form said bath;

said furnace including a plurality of burners submerged within said molten material;

a layer of molten salt supported on top of the molten material within said furnace for removing pollutants from the combustion gases passing up through said molten material from said burners, and a horizontally disposed baffle located within the bath of molten material within said chamber and dividing the same into an upper layer and a lower layer, the molten material in said upper layer moving from said furnace toward the second end of said chamber and the molten material in said lower layer moving from said second end back to said furnace.

7. The apparatus as claimed in claim 6 wherein said molten material is salt.

8. The apparatus as claimed in claim 6 wherein said molten material is metal.

9. The apparatus as claimed in claim 6 wherein said furnace and said chamber are arranged and constructed such that said molten material forms a real between the atmosphere within said furnace and said chamber.

* * * * *

UNITED STATES PATENT AND TRADEMARK OFFICE

CERTIFICATE OF CORRECTION

PATENT NO. : 4,743,341

DATED : May 10, 1988

INVENTOR(S) : Kenneth W. Hladun

It is certified that error appears in the above-identified patent and that said Letters Patent is hereby corrected as shown below:

Column 1, line 22, "commerical" should read --commercial--;

Column 5, line 17, "furace" should read --furnace--;

Column 6, line 37, "real" should read --seal--.

Signed and Sealed this

Eleventh Day of October, 1988

*Attest:*

DONALD J. QUIGG

*Attesting Officer*

*Commissioner of Patents and Trademarks*